US005101608A

United States Patent [19]

Ewers

[11] Patent Number: 5,101,608

[45] Date of Patent: Apr. 7, 1992

[54] ADJUSTABLE BRICK SUPPORT RING

[76] Inventor: Edward F. Ewers, 6336 Lake Ave. S.W., Tacoma, Wash. 98499

[21] Appl. No.: 624,655

[22] Filed: Dec. 10, 1990

[51] Int. Cl.[5] ..... E04G 11/20

[52] U.S. Cl. ..... 52/749; 52/747; 405/146

[58] Field of Search ..... 52/749; 414/10; 269/48.1, 43; 405/146, 148

[56] References Cited

U.S. PATENT DOCUMENTS

| | | | |
|---|---|---|---|
| 1,382,668 | 6/1921 | O'Rourke | 405/146 |
| 3,075,359 | 1/1963 | Clark . | |
| 3,298,155 | 1/1967 | Byfield et al. . | |
| 3,466,883 | 9/1969 | Drenkel . | |
| 3,550,344 | 12/1970 | Maier et al. | 52/749 |
| 3,558,124 | 1/1971 | McMichael | 269/48.1 |
| 3,735,546 | 5/1973 | Newman | 52/749 |
| 3,863,420 | 2/1975 | Peiffer et al. . | |
| 4,363,202 | 12/1982 | Kenyon . | |
| 4,450,666 | 5/1984 | Trumbull et al. | 52/749 |
| 4,584,812 | 4/1986 | Miskolczi, Jr. . | |

OTHER PUBLICATIONS

Pneumat-O-Ring International, Inc., "Expand-O-Ring" Brochure.

*Rock Products*, p. 94, Pneumat-O-Ring International, Inc. Advertisement, Apr. 1990.

*Primary Examiner*—David A. Scherbel
*Assistant Examiner*—Robert Canfield
*Attorney, Agent, or Firm*—Christensen, O'Connor, Johnson & Kindness

[57] ABSTRACT

An adjustable brick support ring (10) formed from a plurality of arcuate ring segments (16, 18) that are pivotally connected to each other in endwise fashion. Each ring segment includes a mating end (40) that is received between two connecting plates (36) that are secured on either side of an engaging end (38) of an adjacent ring segment and project therefrom. A pivot pin (56) is installed through aligned holes in the connecting plates and the overlapped mating end of the ring segment to enable adjacent segments to pivot with respect to each other for adjustment of the size of the arcuate ring. A locking pin (62) is inserted through a selected one of a sequence of locking holes (60) formed in the locking plate at a point radially inwards from the pivot pin, to pass through aligned locking holes (58) formed in the overlapped mating end of the ring segment to prevent rotation of the segments with respect to each other from an adjusted size. The ring is mounted on a slide rail assembly (72) to slide along the length of an adjustable scaffold (12).

18 Claims, 5 Drawing Sheets

ADJUSTABLE BRICK SUPPORT RING

TECHNICAL FIELD

The present invention relates to an adjustable ring for supporting bricks during placement in an arcuate structure, and more particularly to a size adjustable ring for supporting bricks during overhead placement in a kiln.

BACKGROUND OF THE INVENTION

Large diameter cylindrical rotary kilns are frequently used in various industrial processes, such as the calcining of lime, cement and diatomaceous earth, the production of steel pellets, and other manufacturing operations. Conventional kilns consist of a cylindrical steel outer shell with an internal lining of refractory brick. Refractory bricks are placed circumferentially within rows in the kiln. During initial placement or replacement of a brick lining, it is necessary to support bricks in the overhead portion of the kiln until all the bricks in a circumferential row are securely in place, at which time the bricks become self-supporting. Brick support rings have been developed for this purpose.

To line a kiln using a bricking ring, a row of bricks is first placed in the lower half of the kiln, followed by a build-up of the bricks around the upper circumferential half of the kiln, with the bricking ring providing support to the bricks in the upper half as they are placed. A conventional bricking ring that functions in this manner is disclosed by U.S. Pat. No. 3,466,883, and comprises a rigid semicircular ring that is supported by a lower frame within the kiln. The ring includes a plurality of radially-spaced pneumatic cylinders, each pneumatic cylinder having a piston rod extending radially outward therefrom and terminating in a brick support foot. As bricks are stacked within the upper half of the kiln, the pneumatic cylinders are correspondingly activated in sequence to hold the bricks until a complete circle of bricks has been positioned securely in place, at which point the ring may be removed to begin placement of the next course of bricks. While this bricking ring functions satisfactorily, it can be used only to line a kiln having a certain diameter due to the rigid nature of the ring. The only size variation accommodated by the ring is that afforded by limiting the extension of the pneumatic cylinder rods. However, a variety of standard kiln sizes exist, necessitating a kiln lining contreactor to maintain a number of different size rings of this conventional design in order to service a broad base of kilns.

Conventional rigid rings of this type are also ill-suited for use in kilns which vary in diameter over their length. Additionally, in recent years kilns have been manufactured or refurbished to include a layer of insulating brick between the outer shell of the kiln and the inner refractory brick to conserve energy. Unfortunately, the thickness of the insulation bricks is sufficient to render many conventional rings too small for use in the size kilns for which the rings were originally designed.

U.S. Pat. No. 4,450,666 discloses a size-adjustable bricking ring that is more adaptable than conventional rings. The ring consists of a sequence of arcuate sections that are pivotally joined at their ends to form a semicircular ring. The ends of the semicircular ring are joined to a transverse telescoping member of a scaffold support. Each pivotal joint between ring sections is supported by a telescoping radial member extending from the transverse scaffold member outward to the pivotal joint. To increase the size of the ring, the transverse member of the scaffold is telescoped outwardly and the telescoping radial support members are lengthened accordingly to maintain the semicircular conformation of the ring. The ring further includes two telescoping arcuate end sections to increase the overall arcuate length of the ring. This adjustable ring overcomes the narrow applicability of rigid rings. However, this ring is not well suited for use in the narrow confines of kilns. Using conventional bricking techniques, a worker stands on the scaffold and receives refractory bricks passed under the bricking ring by other workers. This conventional, radially supported adjustable ring does not allow the free passage of workers and bricks under the scaffold due to the presence of the telescoping radial supports. The overall structure is also heavy due to the presence of the radial telescoping supports, making it difficult to move the ring within the kiln to place subsequent rows of brick.

SUMMARY OF THE INVENTION

The present invention has been developed to solve the above limitations of conventional bricking rings. The present invention discloses an adjustable ring formed from a plurality of arcuate ring segments that are pivotally connected to each other in end wise fashion, the segments being pivotable with respect to each other to adjust the size of the ring, and including a locking mechanism to selectively lock the segments to each other to prevent pivoting of the segments, thereby imparting rigidity to the size adjusted ring.

In the preferred embodiment, the ring is formed from an arcuate center segment having first and second mating ends and a plurality of arcuate side segments, each side segment having a mating end and an engaging end. Each side segment includes on an engaging end a pair of connecting plates, with one connecting plate secured to each side of the engaging end of the segment. A first portion of each connecting plate is rigidly secured to one side of the segment while a second portion of the connecting plate projects circumferentially past the end of the segment. The mating end of an adjacent side segment or center segment is received between the projecting second portions of the connecting plates of the engaging end of each side segment, with the second portion of each connecting plate overlapping the mating end of the adjacent segment. A pivot pin passes through a radially outward point of the connecting plates and the overlapped mating end of the adjacent segment to pivotally join the segments together.

A passage is formed through the overlapped mating end of the adjacent segment at a point radially inward from the point of pivotal attachment. A sequence of locking passages is formed in the second portion of each of the connecting plates so that the locking passages align sequentially with the overlapped passage in the adjacent segment as the segments are pivoted with respect to each other. To adjust the size of the ring, the segments are pivoted to spread or contract the ring as desired, and a locking pin is then inserted through the aligned passages in the connecting plates and in the mating end of the overlapped segment. Locking in this manner prevents further pivoting of the segments with respect to each other, securing the ring in a size-adjusted rigid configuration.

In the preferred embodiment, the ring is mounted on a scaffold by means of two slide support assemblies to slide along slide rail assemblies secured lengthwise along side the scaffold. The scaffold contains telescoping transverse members and telescoping legs to adjust the width and height of the scaffold corresponding to the adjustment of the ring size. The integral locking mechanism included in the connecting plates allows the ring to be made rigid for use while leaving the semicircular area under the ring completely free for passage of workers and supplies over the scaffold.

The present invention allows for the ring to be easily adjusted over a large range of sizes. In a further aspect of the invention, the ring includes additional arcuate extension segments that are added to the ends of the ring to increase its overall length for use in very large diameter kilns.

The ring further includes a plurality of radially extendable pneumatic cylinder rods that terminate in brick support feet. The feet are mounted pivotally to the radial end of the piston rods and are nominally disposed tangentially to the arc of the ring. The underside of each foot includes a rubber surface that is contacted and slightly compressed by a knurled cylindrical ring secured to the distal end of the piston rods. The friction between the rubber surface and the knurled ring normally prevents the brick support feet from pivoting. However, after the ring size has been readjusted, the force exerted during initial contact of the brick support feet with the bricks is sufficient to overcome the friction and allow for pivotal adjustment of the feet to maintain the feet generally tangential to the arcuate ring.

BRIEF DESCRIPTION OF THE DRAWINGS

The invention will presently be described in greater detail, by way of example, with reference to the accompanying drawings in which.

DETAILED DESCRIPTION OF THE PREFERRED EMBODIMENT

Figure 1:
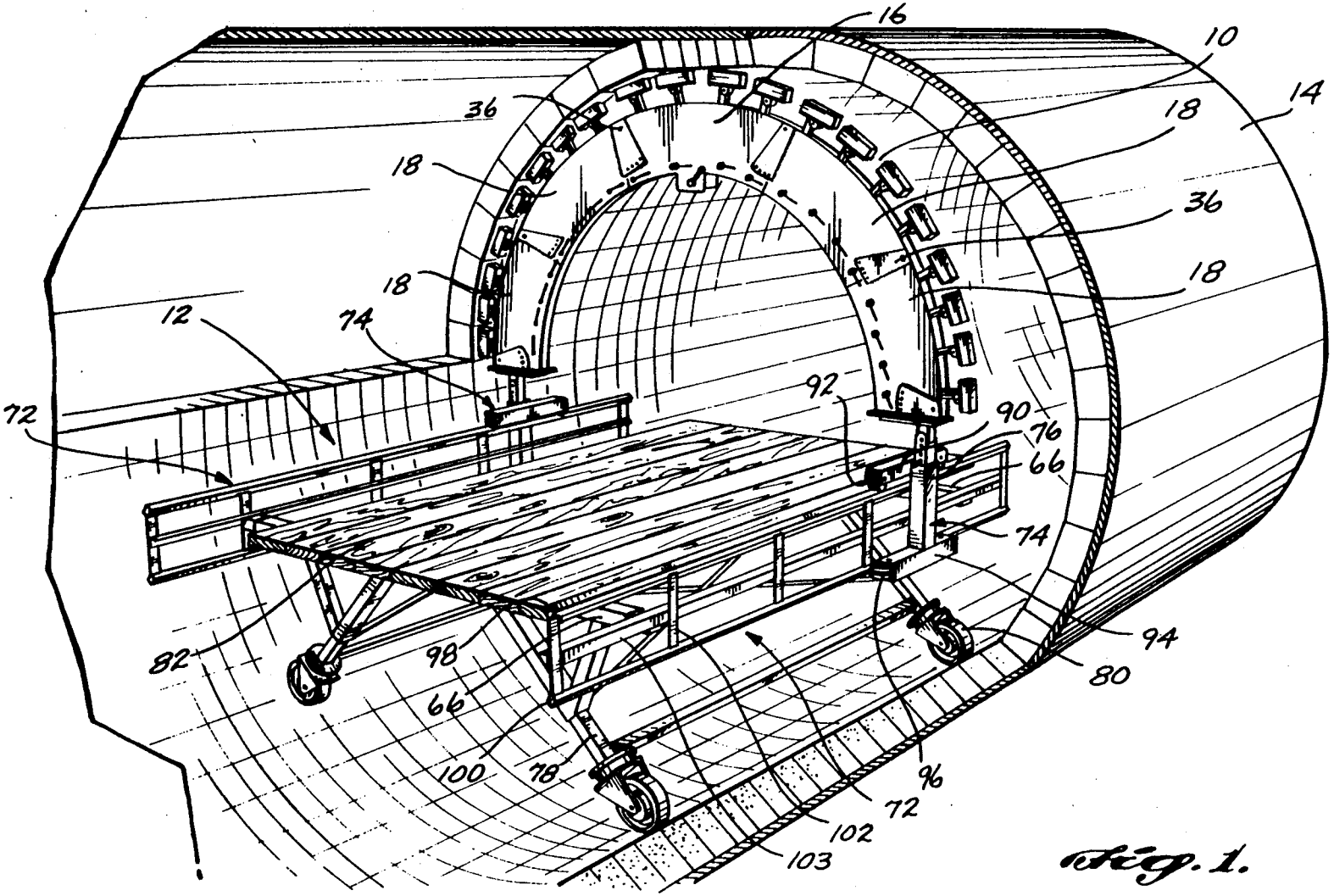
FIG. 1 is a pictorial view of an adjustable ring constructed in accordance with the present invention mounted on a scaffold within a rotary kiln.

FIG. 1 illustrates a preferred embodiment of an adjustable ring 10 mounted on a scaffold 12 within a rotary kiln 14. The ring 10 is formed from at least two ring segments, and in the preferred embodiment illustrated in FIG. 1 includes a center segment 16 and four side segments 18 connected sequentially in endwise fashion to the ends of the center segment 16, for a total of five segments. The segments 16 and 18 are joined together to form a generally semicircular arcuate ring 10.

a. CONSTRUCTION OF THE RING SEGMENTS

Figure 2:
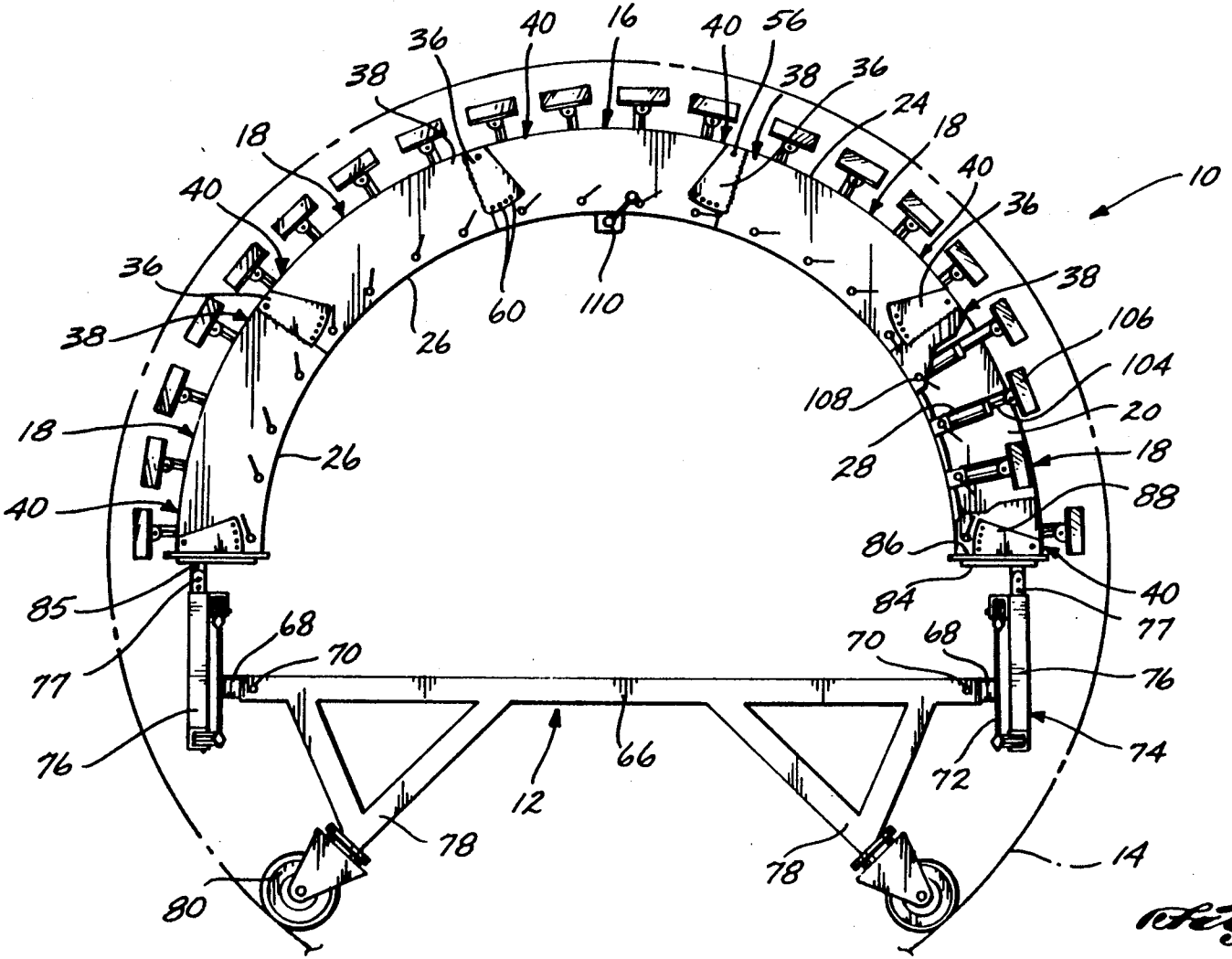
FIG. 2 is a front elevation view of the adjustable ring and scaffold of FIG. 1 adjusted to a minimum diameter, and includes a partial cutaway of the front plate of one ring segment to show the internal pneumatic cylinders and brick support feet in various degrees of extension.
Figure 5:
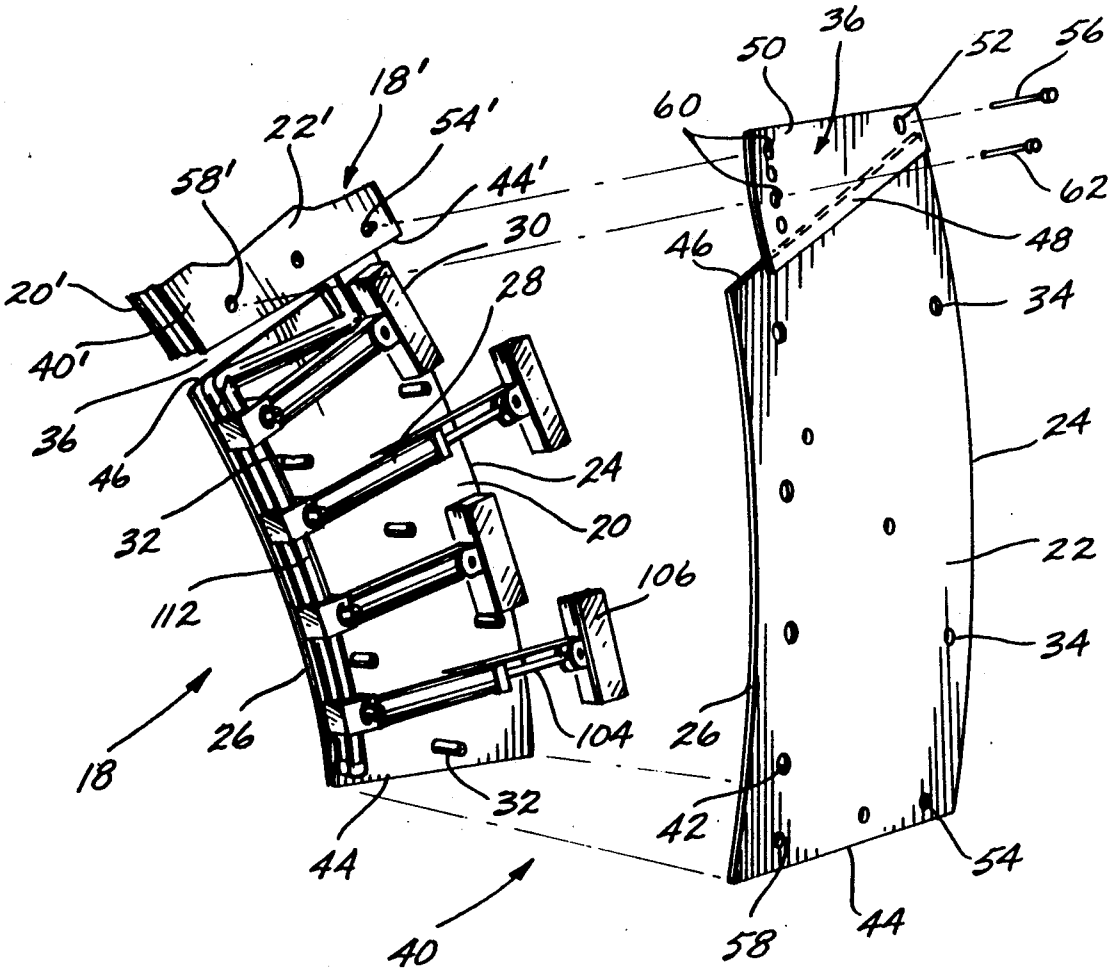
FIG. 5 is an exploded view of one side ring segment.

Reference is now had to FIGS. 1 and 2 together with the exploded view of FIG. 5 to describe the construction and connection of the ring segments 16 and 18.

The center segment 16 and side segments 18 are constructed in similar fashion, with the exception of several differences that are described below. As shown in FIG. 5, which provides an exploded view of a side segment 18, each segment 16 or 18 includes an arcuate, rear segment plate 20 and an identical arcuate, front segment plate 22. The front and rear segment plates 20 and 22 each include an arcuate outer edge 24 and an arcuate inner edge 26. The radial width between the inner edge 26 and outer edge 24 is sufficient to accommodate the length of a plurality of pneumatic cylinders 28 and corresponding brick support feet 30, the purpose and operation of which shall be described subsequently. The rear segment plate 20 and front segment plate 22 are assembled in parallel facing disposition, and are spaced apart by spacers 32 to separate the plates by a sufficient amount to accommodate the pneumatic cylinders 28 and brick support feet 30. Bolts (not shown) or other conventional fasteners are inserted through spacer holes 34 formed in the front and rear segment plates and through aligned spacers 32 to secure the plates together in spaced-apart fashion, thus forming the segment 16 or 18.

b. CONNECTION OF THE RING SEGMENTS

Referring to FIG. 2, the arcuate segments 16 and 18 are joined together by connecting plates 36. Each side segment 18 of the ring includes an engaging end 38 to which two connecting plates 36 are secured and a mating end 40. However, no connecting plates 36 are secured to the center segment 16 of the ring, which instead includes two mating ends 40. To assemble the ring 10, the side segments 18 and center segments 16 are aligned end to end in an arcuate configuration, as shown in FIG. 2. The engaging end 38 of each side segment 18 receives the mating end 40 of an adjacent side segment 18 or center segment 16, with the mating end 40 of the adjacent segment 16 or 18 being inserted between the connecting plates 36 secured to the engaging end 38 of the side segment.

Reference is now made to FIGS. 2 and 5 to describe the operation of the connecting plates 36. FIG. 5 illustrates, by way of example, an exploded view of a side segment 18 that is aligned for connection to an adjacent side segment 18', with the engaging end 42 of the side segment 18 shown disposed for connection to the mating end 40' of the adjacent side segment 18'. It is to be understood that the connection of a side segment 18 to the center segment 16 is performed in similar fashion. The outer surfaces of the rear segment plate 20 and front segment plate 22 of the side segment 18 each include a mating edge portion 44 and an engaging edge portion 46. A connecting plate 36 has a first portion 48 that overlies the engaging edge portion 46 of the front segment plate 22. The first portion 48 of the connecting plates 36 is fixedly secured by welding, riveting, or otherwise fastening to the underlying engaging edge portion 46 of the front segment plate 22. A second connecting plate 36 is secured in the same fashion to overlie the engaging end portion 46 of the rear segment plate 20. Thus, the two connecting plates 36 are secured to the engaging end 38 of the side segment 18 in parallel opposing disposition.

A second portion 50 of each connecting plate 42 extends beyond the engaging end 38 of the side segment 18 to overlap the mating end 40' of the adjacent ring segment 18'. Thus, the mating end 40' of the adjacent segment 18' is received between the connecting plates 36 that are secured to the engaging end 38 of the side segment 18.

The second portion 50 of each connecting plate 36 includes a passage such as a pivot hole 52 that is aligned with corresponding passage or pivot holes 54 formed in the overlapped mating edge portions 44' of the front and rear segment plates 22' and 20' of the adjacent segment 18'. The pivot holes 52 and 54 are disposed at radially outward points within the plates 36 and 20' and 22', respectively, in proximity to the arcuate outer edges 24 of the front and rear segment plates 20' and 22'. A pivot pin 56 is inserted through the aligned holes 52 and 54 to pivotally secure the segments 18 and 18' together. The pivot pin 56 includes a threaded end that receives a nut (not shown) to retain the pin in place. The curvature of the arcuate ring can thus be adjusted by pivoting the segments 16 and 18 with respect to each other about the pins 56.

Referring to FIGS. 2 and 5, the connection plate also includes a mechanism for securing the segments 16 and 18 together after the ring has been adjusted to a particular desired size. A passage such as a locking hole 58 is formed in the mating edge portion 44 of the front and rear segment plates 22 and 20 of each segment 16 and 18 at a point radially inward from the pivot hole 54. The locking holes 58 in the plates 22 and 20 of each segment are aligned. At a corresponding point radially inward from the pivot hole 52, a sequence of passages such as locking holes 60 is formed in each locking plate 36. The locking holes 60 are disposed at spaced-apart intervals along a slightly arcuate line. Referring to FIG. 5, when two segments such as side segments 18 and 18' are assembled, the sequence of locking holes 60 in the connecting plate 36 are radially aligned with the locking holes 58' formed in the mating end 40' of the segment 18'. As the side segments 18 and 18' are pivoted with respect to each other, sequential holes 60 in each locking plate 36 align with the underlying holes 58' of the side segment 18'. When the side segments 18 and 18' have been pivoted with respect to each other about pin 56 to a setting corresponding to a desired size of the locking ring 10, a locking pin 62 is inserted through aligned holes 60 and 58'. The locking pin 62 includes a threaded end that receives a nut (not shown) to secure the locking pin in place. When installed, the pivot pins 56 and locking pins 62 extend completely through both connecting plates 36 secured to the front and rear segment plates 20 and 22 of the side segment 18 as well as through the rear and front segment plates 20' and 22' of the adjacent side segment 18'.

C. ADJUSTMENT OF THE RING

Figure 3:
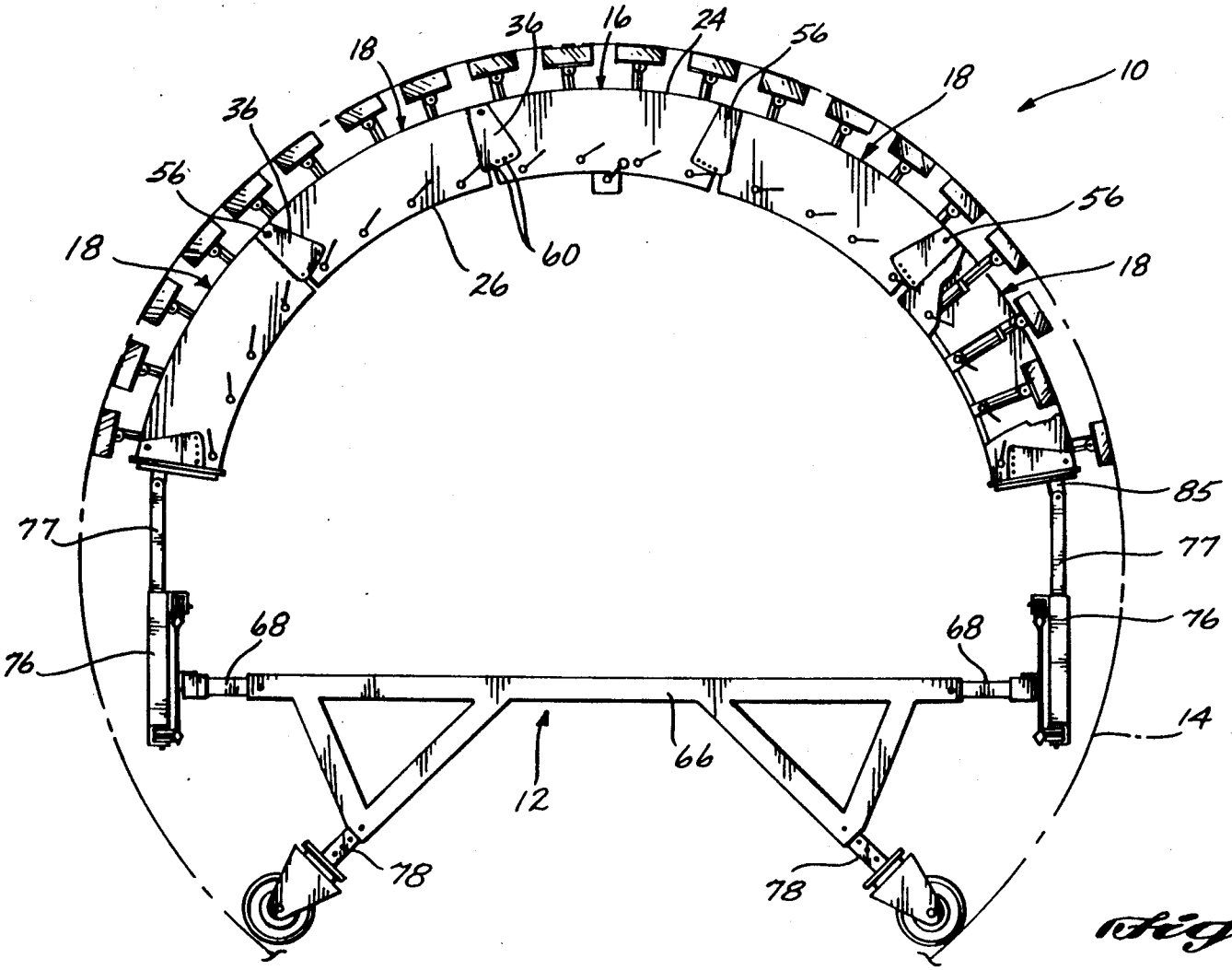
FIG. 3 is a front elevation view of the ring and scaffold of FIG. 1 shown adjusted to an intermediate diameter.
Figure 4:
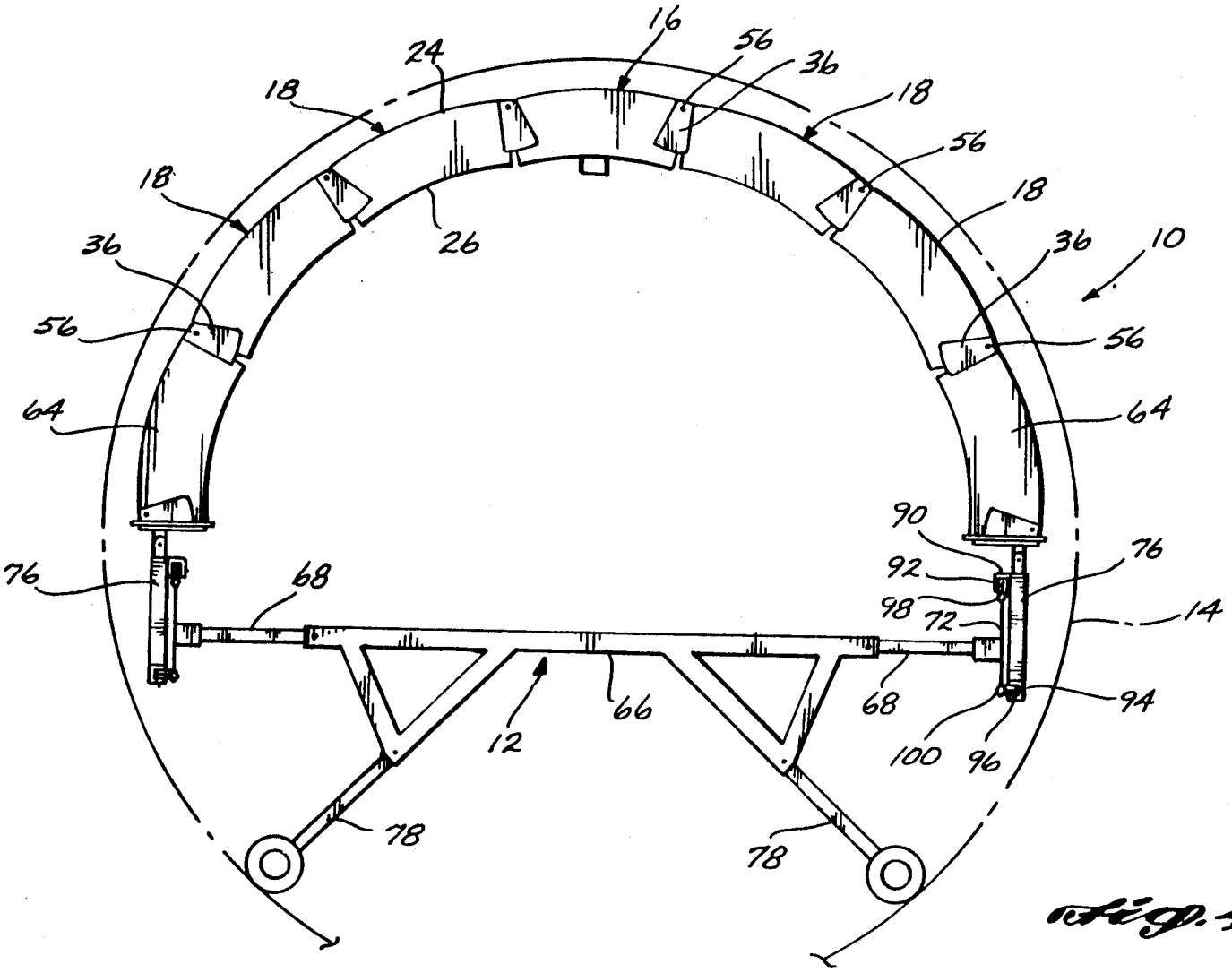
FIG. 4 is a front elevation schematic view of the ring and scaffold in FIG. 1 extended to a maximum diameter, and further illustrates the addition of two extension segments to increase the arcuate length of the ring.

Reference is now had to FIGS. 2 through 4 to describe the adjustment of the diameter of the ring 10. In FIG. 2, the ring 10 is shown adjusted for a small diameter kiln. The ends of the arcuate inner edges 26 of each segment 16 and 18 are proximate to each other, there being substantially no spread between the segments. The arcuate outer edges 24 of the segments of the ring 10 form a generally smooth arcuate line. The locking pins 62 are inserted through a selected one of the locking holes 60, formed in each locking plate 36, that is disposed closest to the engaging ends 38 of the side segments 18.

In FIG. 3, the arcuate segments 16 and 18 have been spread to increase the overall diameter of the ring 10. This is accomplished in part by removing the locking pins 62 from the aligned locking holes 60 and 58 and allowing the segments to pivot with respect to each other about pivot pins 56. Adjustments are also made to the scaffold 12 at the same time, as shall be described subsequently. After the segments 16 and 18 have been pivoted with respect to each other to spread the ring, the locking pins 62 are reinserted through newly aligned locking holes 60 and 58. The locking holes 60 selected to secure the ring in this spread configuration are disposed at a point more distant from the engaging ends 38 of the side segments 18 than the holes 60 selected for the minimum diameter ring shown in FIG. 2. In the enlarged configuration of FIG. 3, the ends of the inner arcuate edges 26 of the segment 16 and 18 are spread slightly away from each other, while the outer arcuate edges 24 of the segments 16 and 18 form a slightly scalloped arcuate line.

FIG. 4 shows the ring 10 further adjusted to accommodate an even larger kiln than that accommodated by the adjustment of FIG. 3. The adjustment mechanism is the same as that previously described, resulting in an even greater spread between the ends of the arcuate inner edges 26 of the segments 16 and 18 and an increased scalloping effect in the arcuate line defined by the arcuate outer edges 24 of the segment 16 and 18.

FIG. 4 also illustrates the addition of two arcuate extension segments 64 to increase the arcuate length of the ring 10. The ring 10 must have sufficient arcuate length to support the uppermost half of each circumferential row of bricks in the kiln. When the ring 10 has been adjusted to increase the diameter above a particular size, the length of the arcuate ring is no longer sufficient to span half the circumference of the kiln. It then becomes necessary to add one or more extension ring segments 64. The extension segments 64 are constructed and connected identically to side segments 18. However, if necessary to obtain a particular diameter of ring, an extension segment 64 having arcuate length less than the side segments 18 may be utilized. For instance, extension segments 64 that have an arcuate length approximately half that of the side segments 18, and containing therein half the number of pneumatic cylinders 28, may be added to ring 10. Similarly, different combinations of more than two extension segments may be added to the ring to increase its length further.

d. ADJUSTMENT OF THE SCAFFOLDING

Reference is again had to FIGS. 2 through 4 to describe the adjustment of the scaffold 12 to correspond to the adjustment of the ring 10. As the ends of the ring 10 are mounted to the scaffold in a manner to be subsequently described, the transverse width of the scaffold 12 must be increased or decreased in conjunction with corresponding changes in the size of the ring 10. To accommodate this adjustment, the scaffold includes at least one, and preferably two, transverse scaffold members 66 that telescope to increase or decrease their lengths as required for adjustment of the ring. In a preferred embodiment illustrated in FIG. 2, the transverse member is constructed from a length of rectangular tubular metal. Two transverse scaffold extensions 68 are slid into the ends of the transverse member 66, and have outer perimeters corresponding to but slightly smaller than the inner perimeter of the transverse member 66. A transverse pin 70 is inserted through a hole formed in proximity to each end of the transverse scaffold member 66 that aligns with a selected one of a series of corresponding holes formed in the extension members 68 to secure the extension members for a desired width of the scaffold 12. FIGS. 3 and 4, respectively, show the scaffold adjusted to increase the width of the scaffold member 66 by extending extension members 68 corresponding to the increased distance between the ends of the ring 10.

Reference is now had to FIGS. 1 and 2 to describe the mounting of the ring 10 onto the scaffold 12. FIG. 1 illustrates the preferred embodiment of the scaffold 12 including two telescoping transverse members 66. A slide rail assembly 72 is mounted alongside either side of the scaffold 12 to the distal ends of the extension segments 68 that project from the transverse member 66. The slide rail assemblies are disposed generally parallel to each other and to the longitudinal axis of the ring 10 and scaffold 12. A slide support assembly 74 is slidably mounted on each of the slide rail assemblies 72 in a manner to be described subsequently. Each of the slide support assemblies includes a substantially upright telescoping support member 76 in which is mounted an extension member 77 that supports the ends of the arcuate ring 10. As can be seen in FIGS. 2, 3 and 4, the telescoping upright supports 76 are adjusted by inserting a pin (not shown) into a selected aligned set of holes, in the same manner as the transverse telescoping member 66, to raise or lower the height of the arcuate ring 10 as required to position it correctly in proximity to the overhead wall of a kiln 14. Note that in FIG. 4, although the ring diameter has been increased from the configuration of FIG. 3, the upright telescoping supports 76 have been collapsed back closer to the nominal position due to the addition of the extension ring segments 64 to lengthen the arcuate length of the ring 10.

Referring to FIGS. 1 and 2, the scaffold 12 also includes four radially downwardly projecting telescoping leg supports 78 that terminate in caster wheels 80. The caster wheels 80 swivel to accommodate both sliding of the entire ring 10 and scaffold 12 assembly along the length of a kiln 14, as well as rotation of the kiln, if necessary, during the brick laying process. As can be seen in FIGS. 2 through 4, the telescoping leg supports 78 may be extended or retracted, in the same manner as the transverse telescoping member 66, to accommodate readjustment of the height of a working platform 82 of the scaffold (shown in FIG. 1) as well as the ring 10 within the kiln.

e. MOUNTING OF THE RING ON THE SCAFFOLD

Reference is again had to FIG. 2 to describe with greater detail the mounting of the ends of the ring 10 to the slide support assemblies 74. A generally horizontal bottom support plate 84 is pivotally secured to the top of each telescoping upright extension member 77. A pivot boss 85 projects downwardly from the underside of the bottom support plate 84 and is received within the upper end of the telescoping extension member 77. As shown most clearly in FIGS. 2 and 3, the pivot boss 85 is pivotally secured to the upper end of the telescoping member 77 by a pin (not shown), thereby allowing the bottom support plate 84 to pivot with respect to the telescoping support 76 as required to accommodate changes in the diameter of the ring 10.

A corresponding top support plate 86 overlies each bottom support plate 84, and is secured in place by bolts (not shown), or other conventional fasteners. Two modified connecting plates 88 are welded or otherwise secured to, and project upwardly from each top support plate 86. The modified connecting plates 88 are identical to the previously described connecting plates 36, with the exception that the circumferential width of the plate 88 is reduced. The mating end 40 of an adjacent side segment 18 or extension segment 64, depending on the size configuration of the ring, is received between each set of modified connecting plates 88. The mating end 40 of the adjacent side segment 18 or extension segment 64 is pivotally connected to the modified connecting plates 88, and selectively secured from pivoting with a locking pin (not shown), in the identical manner as previously described for connecting ring segments together.

Reference is now had to FIGS. 1 and 2 to further describe the construction of the slide rail assemblies 72 and the slide support assemblies 74. The slide rail assembly 72 includes the upright support member 76 to which the ends of ring 10 are mounted via the extension members 77. A length of downwardly opening U-shaped channel 90 is mounted transversely at approximately its midpoint to the inside of the upper end of the upright support member 76. The slide support assembly 74 further includes a second inwardly opening U-shaped channel 94 mounted at approximately its midpoint to the bottom end of the telescoping upright support 76. The channels 90 and 94 are disposed generally parallel to the longitudinal axis of the ring 10 and scaffold 12. Each end of the U-shaped channel 90 houses an upper roller 92 that is rotatably mounted on a shaft installed across the channel. A second set of lower rollers 96 is rotatably mounted within each end of the U-shaped channel 94 in the same manner. The rollers 92 and 96 each include a V-shaped notch formed about their circumferences.

Each slide rail assembly 72 includes an upper rail 98 and a lower rail 100 that are disposed parallel to each other and to the longitudinal axis of the ring 10 and scaffold 12, with the upper rail 98 disposed above and spaced apart from the lower rail 100. The rails 98 and 100 each have a diamond-shaped cross section. The upper and lower rails 98 and 100 are mounted in this disposition to a plurality of cross members 102 having first ends affixed to the upper rail 98 and second ends affixed to the lower rail 100. The cross members 102 are each secured at a point between their ends to a longitudinal member 103. Each longitudinal member 103 is affixed to the ends of the transverse telescoping scaffold extension member 68.

Each of the slide support assemblies 74 are detachably mounted to a corresponding slide rail assembly 72 by engaging the upper rollers 92 on the upper side of the upper rail 98 and the lower rollers 96 on the outside of the lower rail 100. The upper rollers 92 provide the primary support for the downward force exerted by the weight of the ring 10. The lower rollers 96 act to counter the moment generated by the weight of the ring about the point of pivotal connection of the pivot bosses 85 to the upper end of the telescoping upright support members 77, acting to stabilize the ring 10.

The mounting of the slide support assemblies 74 on the slide rail assemblies 72 allows the ring to be slid longitudinally within the kiln, along the length of the scaffold 12, during the bricking of a kiln. With the completion of each circumferential row of bricks, the ring may be slid to align incrementally with the next row of bricks. This process is repeated until the ring has been moved to the point where a worker can no longer stand on the platform surface 82 of the scaffold 12 to work with the ring, at which point the entire scaffold 12 is advanced axially within the kiln and the ring 10 is slid back to its starting position. The ring may then be slidably advanced along the length of the scaffold again to repeat the process.

e. Pneumatic System and Brick Support Feet

Each ring segment 16 and 18 includes a number of pneumatic cylinders 28 housed within the body of the segment between the front and rear segment plates 22 and 20. The cylinders 28 are disposed radially with respect to the arc of the ring 10, and are spaced evenly about the ring. Referring to FIG. 2, each cylinder 28 includes an extendable piston rod 104. A brick support foot 106 is mounted across the radially distal end of each piston rod 104. Each piston rod 104 may be retracted within the pneumatic cylinder 28 to retract the brick support feet 106 within the body of the segments 16 and 18. The piston rods 22 may also be extended to project radially outward from the segment to push the brick support feet 106 against bricks for placement in the kiln. The placement of a piston rod 104 in either the retracted or extended position is controlled by individual double-acting pneumatic valves 108 mounted in pneumatic communication with each cylinder 28.

Referring to FIG. 1, during construction of the upper half of a circumferential row of bricks the brick support feet 106 are extended in sequential fashion by operation of individual pneumatic valves 108 starting at the two ends of the ring and working upwardly from each end towards the center of the ring as the bricks are placed. The ring 10 further includes a master valve 110, connected by tubing 112 (shown in FIG. 5) to a pneumatic air supply and each cylinder 28, that acts to change the extended position of each piston rod simultaneously. The use of pneumatic cylinders to extend brick support members is well known in the art, and is more fully described in U.S. Pat. No. 3,466,883, which is hereby incorporated by reference.

Figure 6:
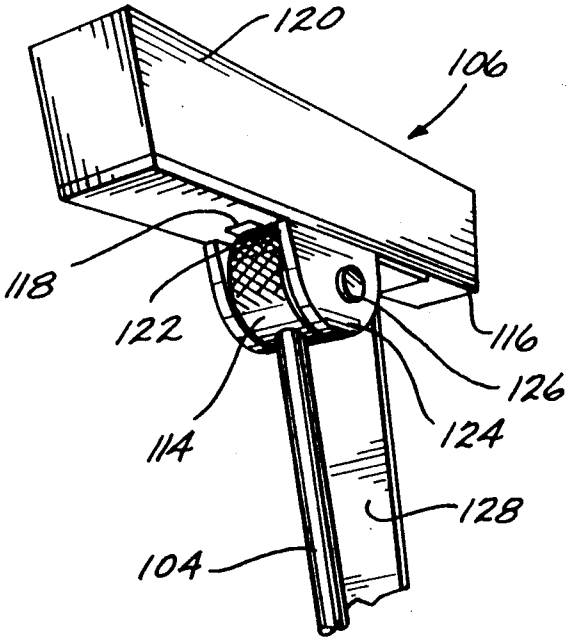
FIG. 6 is a pictorial view illustrating the adjustable pivotal mounting of a brick support foot on the end of an extendable piston rod.

In an additional aspect of the invention, the brick support feet 106 are mounted pivotally to the distal ends of the piston rods 104 to allow for adjustment of the orientation of the brick support feet 106 with respect to the rods 104 upon adjustment of the size of the ring. Referring to FIG. 6, a cylindrical ring 114 is mounted on its side to the radially distal end of each piston rod 104. The ring 114 may be threaded, welded, or otherwise secured to the end of the rod 104. The outer circumferential surface of the ring 114 is knurled to provide a rough, frictional surface.

Each brick support foot includes a rectangular base plate 116. A rectangular slot 118 is formed centrally through the plate 116. A layer of elastomeric material 120 is bonded to the upper surface of the base plate 116, and is formed to fill the slot 118, extending to the lower surface of the plate 116. The elastomeric layer 120 is preferably molded in place, during which the elastomeric material is vulcanized to the plate and is forced by the mold pressure to fill the slot 118. Alternatively, a pre-molded elastomeric layer 120 having a projection conforming to the slot 118 may be adhered in place. The elastomeric material filling the slot 118 presents a rectangular elastomeric surface 122 on the underside of the base plate 116. The base plate 116 includes two pivot flanges 124 that extend downwardly from the base plate on either side of the slot 118. The cylindrical ring 114 on the piston rod 104 is mounted between the flanges 124 on a pivot pin 126. The mounting is such that the knurled surface of the ring 114 contacts and slightly compresses the rubber surface 122.

Friction between the rubber surface 122 and the knurled surface of the ring 114 is normally sufficient to prevent pivoting of the brick support foot 106 with respect to the piston rod 104. When the size of the ring has been adjusted, the individual brick support feet 106 may be misplaced from a desired position approximately tangential to the arc of the ring, in which position the feet 106 align with bricks being installed within the kiln. However, when each rod 104 is initially extended after adjustment of the ring, the elastomeric layer 120 of the brick support foot 106 contacts the row of bricks with the force of the contact being sufficient to overcome friction between the knurled surfaces of the ring 114 and the rubber friction surface 122, allowing the brick support foot 106 to pivot with respect to the piston rods 104. The foot 106 will then remain in this position until again contacting the brick at other than the preferred position.

A bar 128 projects downwardly from the underside of the plate 116, extending between the segment plates 20 and 22 of the segments 16 and 18 to prevent rotation of the piston rods 104.

Although the brick support feet 106 have been described as rectangular, elastomeric-covered feet, a variety of other types of feet may be utilized in accordance with the present invention. For instance, cylindrical feet having a circular contact surface may be used.

F. ALTERNATIVE PREFERRED EMBODIMENTS

The above preferred embodiment of a ring 10 has been described as illustrative of an adjustable brick support ring constructed in accordance with the current invention. However, various alterations to the described embodiment may be made and still fall within the scope of the invention. In the brick ring 10 described above, a center section 16 having two mating ends 40, and a plurality of side sections 18 having one mating end 40 and one engaging end 38, are utilized. However, it should be apparent that other combinations of ring segments may be used. For instance, a ring may be constructed utilizing a center section 16 that has two engaging ends (i.e., ends on which connection plates 36 are secured), in which case each of the side segments would still include one engaging end and one mating end. However, the engaging ends of each of the side segments on the end of the ring would engage with a mating structure mounted on the ring support plates, rather than being received within modified contacting plates 88.

As another example, rather than having a number of side segments and a distinct center segment, all of the segments in the ring could be constructed identically. In that case, each segment would have one receiving end and one mating end, with the supporting structures on the scaffold configured accordingly. Other combinations of engaging and mating ends on ring segments could also be utilized in accordance with the present invention.

The preferred embodiment is described as utilizing arcuate ring segments. The arcuate configuration of individual segments is preferable in order to construct a ring with an overall arcuate configuration using a relatively small number of individual segments. However, it should be apparent that segments that are straight from end to end may be connected in the above-described manner to form a ring of overall arcuate configuration. It should also be apparent that rather than having individual segments of uniform length, a ring may be constructed utilizing segments that are of differing lengths, according to the desired end configuration for the ring.

In the above preferred embodiment, the connecting plates 36 serve to both pivotally connect adjacent segments utilizing the pivot pins 56, as well as selectively secure adjacent segments together using locking pins 62. It should be apparent that separate structures can be included on each segment to perform these functions. For instance, one end of a segment may include flanges that receive the adjacent segment for mounting of a pivot pin therethrough at a radially outward point. A bar may then be included that is pivotally connected at one end to one segment, with the other end of the bar being selectively pinned through one of a series of holes formed in the adjacent segment to secure the ring a size-adjusted position.

The above support ring has been described for use in the placement of bricks in a kin. However, it should be apparent that a device constructed in accordance with the present invention could also be used to place bricks in other arcuate structures, such as furnaces or tunnels.

One of ordinary skill, after reading the foregoing specification, will be able to effect various other changes, alterations and substitutions of equivalents without departing from the broad concepts disclosed. It is therefore intended that the scope of Letters Patent granted hereon be limited only by the definition contained in the appended claims and the equivalents thereof.

The embodiments of the invention in which an exclusive property or privilege is claimed are defined as follows:

1. An adjustable ring for supporting bricks during overhead placement in an arcuate structure, comprising:

a plurality of adjacent ring segments forming, a generally arcuate ring having first and second ends;

adjustment means for adjusting the curvature of the ring; and securement means integral with the ring for securing the ring in an adjusted configuration and for rigidly maintaining the ring in the adjusted configuration so that the ring remains rigid when supported at only the first and second ends of the ring, and to permit unobstructed passage under the ring, the adjustment means comprises pivot means for pivotally connecting the ring segments in an endwise sequence to form the ring, the ring segments being pivotable with respect to each other to adjust the curvature of the ring; and the securement means comprises a plurality of connecting members, each connecting member being selectively securable to two adjacent, pivotally connected ring segments to prevent the pivoting of the two adjacent, pivotally connected segments from an adjusted configuration.

2. The adjustable ring of claim 1, wherein the ring segments have an arcuate configuration.

3. The adjustable ring of claim 2, further comprising:

a plurality of connecting plates, each connecting plate having a first portion secured to a ring segment and a second portion overlapping an adjacent ring segment, wherein:

the pivot means pivotally connects the second portion of the connecting plate to the overlapped ring segment at a radially outward point; and the securement means comprises pin means mounted through a passage formed in the overlapped ring segment at a radially inward point for selectively engaging with a sequence of passages formed in the second portion of the connecting plate to prevent pivoting from an adjusted configuration.

4. The adjustable ring of claim 2, further comprising at least one arcuate extension segment pivotally connectable and selectively securable to an end of the arcuate ring to increase the length of the arcuate ring.

5. The adjustable ring of claim 1, further comprising an adjustable scaffold supporting the arcuate ring.

6. The adjustable ring of claim 1, further comprising:

a plurality of extendable rods projecting radially around the ring;

a plurality of brick support feet mounted transversely on the radial ends of the extendable rods and approximately tangential to the ring; and means for selectively pivoting the brick support feet with respect to the extendable rods to maintain the brick support feet approximately tangential to the ring after adjustment of the ring.

7. The adjustable ring of claim 1, further comprising at least one extension segment selectively securable to the ring to extend the length of the arcuate ring.

8. An adjustable ring having a generally arcuate ring configuration and mountable on a scaffold for supporting bricks during overhead placement in arcuate structures of differing sizes, comprising:

a plurality of arcuate segments pivotally connected to each other in endwise fashion, the segments being pivotable with respect to each other to adjust the size of the ring; and locking means included on the segments for selectively locking the segments to each other, independently of a scaffold, to prevent pivoting of the segments, thereby imparting rigidity to the size-adjusted ring and permitting unobstructed passage under the ring.

9. An adjustable ring having a generally arcuate configuration for supporting bricks during overhead placement in arcuate structures of differing sizes, comprising:

a plurality of arcuate segments pivotally connected to each other at a radially outward point in endwise fashion, the segments being pivotable with respect to each other to adjust the size of the ring; and locking means to selectively secure the segments to each other at a radially inward point to prevent pivoting of the segments, thereby imparting rigidity to the size-adjusted ring and permitting unobstructed passage under the ring.

10. The adjustable ring of claim 9, further comprising a plurality of connecting plates, each connecting plate having a first portion secured to a corresponding first segment and a second portion overlapping an adjacent second segment, wherein:

the second portion of the connecting plate is pivotally secured to the second segment at a radially outward point; and the locking means comprises pin means mounted through a passage formed in the second segment at a radially inward point for selectively engaging with a sequence of passages formed in the second portion of the connecting plate to prevent pivoting of the second segment relative to the first segment.

11. The adjustable ring of claim 8, wherein each segment comprises:

an arcuate front segment plate; and an arcuate rear segment plate secured in spaced parallel relationship to the front segment plate.

12. The adjustable ring of claim 11, further comprising:

a plurality of front connecting plates, each front connecting plate having a first portion secured to the front segment plate of a first segment and a second portion overlapping the front segment plate of an adjacent second segment;

a plurality of rear connecting plates, each rear connecting plate having a first portion secured to the rear segment plate of the first segment and a second portion overlapping the rear segment plate of the second segment, wherein:

the second portions of the front and rear connecting plates are pivotally secured to the second segment at a radially outward point;

the front segment plate and the rear segment plate of the second segment each include an aligned passage formed at a radially inward point;

the second portions of the front and rear connecting plates each include a sequence of locking passages disposed to sequentially align with the passages formed in the overlapped front segment plate and rear segment plate of the second segment as the second segment is pivoted relative to the first segment; and the locking means comprises pin means insertable through the aligned passages in the front segment plate and rear segment plate of the second segment and selected aligned passages in the front and rear connecting plates to prevent pivoting of the second segment relative to the first segment.

13. The adjustable ring of claim 8, further comprising an adjustable scaffold supporting first and second ends of the arcuate ring, the scaffold being positionable axially within the arcuate structures.

14. The adjustable ring of claim 13, further comprising means for slidably mounting the arcuate ring to the scaffold, the means for slidably mounting comprising:

a lower rail secured along each side of the scaffold;

an upper rail secured along each side of the scaffold and disposed above the lower rail;

first roller means mounted to each end of the ring for rolling along the upper rails to support the ring; and second roller means projecting downwardly from each end of the ring for rolling along the lower rails to stabilize the ring.

15. The adjustable ring of claim 8, further comprising at least one arcuate extension segment selectively securable to the arcuate ring to extend the length of the arcuate ring.

16. The adjustable ring of claim 8, further comprising:

a plurality of extendable rods projecting radially around the arcuate ring;

a plurality of brick support feet mounted transversely on the radial ends of the extendable rods and approximately tangential to the arcuate ring; and means for selectively pivoting the brick support feet with respect to the extendable rods to maintain the brick support feet approximately tangential to the arcuate ring after adjustment of the arcuate ring.

17. The adjustable ring of claim 16, wherein the means for selectively pivoting the brick support feet comprises:

a first friction surface formed on the brick support feet; and a second friction surface included on the extendable rods to engage with the first friction surface, the frictional engagement of the first and second friction surfaces normally preventing pivoting of the brick support feet, but allowing the first and second friction surfaces to slip as the brick support feet come into contact with bricks within the arcuate structure to pivot the brick support feet.

18. The adjustable ring of claim 17, wherein:

the first friction surface is formed from an elastomeric material; and the second friction surface is formed by a knurled ring secured to each extendable rod that compressively engages the first friction surface.

* * * * *